US006158589A

United States Patent [19]

Smith et al.

[11] Patent Number: 6,158,589

[45] Date of Patent: Dec. 12, 2000

[54] BOXES WITH INTERNAL RESILIENT ELEMENTS

[75] Inventors: Jeffrey A. Smith, Clark; Richard N. Beneroff, Harding Township; Eric Kim, Secaucus, all of N.J.

[73] Assignee: Motion Design, Inc., Linden, N.J.

[21] Appl. No.: 09/404,044

[22] Filed: Sep. 23, 1999

[51] Int. Cl.[7] ..... B55D 81/07

[52] U.S. Cl. ..... 206/466; 206/591; 206/594; 206/583

[58] Field of Search ..... 206/320, 462, 206/463, 466, 497, 583, 591, 594

[56] References Cited

U.S. PATENT DOCUMENTS

| | | | |
|---|---|---|---|
| Re. 30,098 | 9/1979 | Titchenal et al. | 206/484 |
| 457,390 | 8/1891 | Weeks | 206/739 |
| 1,730,437 | 10/1929 | Sanderson | 706/735 |
| 1,985,075 | 12/1934 | Bird | 706/418 X |
| 2,032,386 | 3/1936 | Wood | 206/807 X |
| 2,114,422 | 4/1938 | Guyer | 206/807 X |
| 2,956,672 | 10/1960 | Kirkpatrick | 206/497 |
| 3,089,590 | 5/1963 | Mell . | |
| 3,322,263 | 5/1967 | Gulliver | 206/497 |
| 3,375,921 | 4/1968 | Ligon | 206/463 |
| 3,456,780 | 7/1969 | Forman | 206/46 |
| 3,507,383 | 4/1970 | Rorer . | |
| 3,544,007 | 12/1970 | Bordman | 206/779 X |
| 3,600,872 | 8/1971 | Sharpnack, Jr. | 53/30 |
| 3,627,116 | 12/1971 | Cooper | 206/45.33 |
| 3,669,337 | 6/1972 | Struble | 229/14 BA |
| 3,750,872 | 8/1973 | Bobb | 206/46 FN |
| 3,752,301 | 8/1973 | Bluemel | 206/46 FR |
| 3,796,307 | 3/1974 | McKinney | 206/521 |
| 3,853,220 | 12/1974 | Luray | 206/466 |
| 3,905,474 | 9/1975 | Haibara . | |
| 3,946,870 | 3/1976 | Gajer et al. | 206/497 X |
| 4,030,603 | 6/1977 | Angell | 206/521 |
| 4,087,003 | 5/1978 | Adamek | 206/583 |
| 4,180,165 | 12/1979 | Kuchenbecker | 206/779 X |
| 4,285,432 | 8/1981 | de Villers et al. | 206/591 |
| 4,306,653 | 12/1981 | Fales | 206/326 |
| 4,307,804 | 12/1981 | Benham . | |
| 4,328,896 | 5/1982 | Behne | 206/497 |
| 4,488,466 | 12/1984 | Jones . | |
| 4,606,459 | 8/1986 | Luray | 206/583 |
| 4,757,900 | 7/1988 | Misset et al. | 206/497 |
| 4,852,743 | 8/1989 | Ridgeway | 206/583 |
| 4,923,065 | 5/1990 | Ridgeway | 206/583 |
| 5,044,495 | 9/1991 | Wyslotsky | 206/497 X |
| 5,056,665 | 10/1991 | Boecker et al. | 206/583 |
| 5,071,009 | 12/1991 | Ridgeway | 206/586 |
| 5,086,925 | 2/1992 | Coalier et al. | 206/497 |
| 5,108,803 | 4/1992 | Kondo et al. | 428/34.2 |
| 5,129,518 | 7/1992 | Tanaka et al. | 206/497 |
| 5,218,510 | 6/1993 | Bradford | 361/220 |
| 5,226,531 | 7/1993 | Garwood | 206/213.1 |
| 5,226,542 | 7/1993 | Boecker et al. | 206/583 |
| 5,240,111 | 8/1993 | Yamashita et al. | 206/497 |
| 5,251,760 | 10/1993 | Smith et al. | 206/583 |
| 5,259,507 | 11/1993 | Smith | 206/583 |
| 5,287,968 | 2/1994 | Ridgeway | 206/583 |

(List continued on next page.)

FOREIGN PATENT DOCUMENTS

| | | |
|---|---|---|
| 638038 | 3/1962 | Canada . |
| 670168 | 9/1963 | Canada . |
| 691904 | 8/1964 | Canada . |
| 2564068 | 11/1985 | France . |
| 2771380 | 5/1999 | France . |

(List continued on next page.)

*Primary Examiner*—Jim Foster
*Attorney, Agent, or Firm*—Kenyon & Kenyon

[57] ABSTRACT

A packaging item is provided, wherein a resilient element supports, suspends and/or holds down an item or items to be shipped. The resilient element may be attached to a platform or strap flap of a relatively rigid sheet. For example, the resilient element may comprise a plastic film glued to a sheet of corrugated cardboard. The sheet may have different shapes, apertures, and/or item loading sites to accommodate variously shaped items. The packaging item may be an insert for a box or a shipping folder.

19 Claims, 11 Drawing Sheets

U.S. PATENT DOCUMENTS

| | | | |
|---|---|---|---|
| 5,323,896 | 6/1994 | Jones | 206/223 |
| 5,388,701 | 2/1995 | Ridgeway | 206/583 |
| 5,579,917 | 12/1996 | Lofgren et al. | 206/583 |
| 5,669,506 | 9/1997 | Lofgren et al. | 206/583 |
| 5,676,245 | 10/1997 | Jones | 206/223 |
| 5,678,695 | 10/1997 | Ridgeway et al. | 206/583 |
| 5,694,744 | 12/1997 | Jones | 53/449 |
| 5,722,541 | 3/1998 | Lofgren et al. | 206/583 |
| 5,894,932 | 4/1999 | Harding et al. | 206/583 |
| 5,967,327 | 10/1999 | Jones | 206/583 |

FOREIGN PATENT DOCUMENTS

| | | | |
|---|---|---|---|
| 0969457 | 6/1958 | Germany | 206/418 |
| 49-59982 | 5/1974 | Japan . | |
| 49-77087 | 7/1974 | Japan . | |
| 50-88376 | 7/1975 | Japan . | |
| 50-102778 | 8/1975 | Japan . | |
| 50-107583 | 9/1975 | Japan . | |
| 57-177969 | 11/1982 | Japan . | |
| 3-100158 | 10/1991 | Japan . | |
| 0022483 | 9/1930 | Netherlands | 206/418 |
| 0360646 | 4/1962 | Switzerland | 206/418 |
| 237322 | 7/1925 | United Kingdom . | |
| 904628 | 8/1962 | United Kingdom | 206/45.34 |
| 1425746 | 2/1976 | United Kingdom . | |
| 1426331 | 2/1976 | United Kingdom . | |
| 1561596 | 2/1980 | United Kingdom . | |
| 2239854 | 7/1991 | United Kingdom . | |
| 86/02336 | 4/1986 | WIPO . | |
| 98/18694 | 5/1998 | WIPO . | |

BOXES WITH INTERNAL RESILIENT ELEMENTS

BACKGROUND OF THE INVENTION

The invention relates to packaging in general, and, more particularly, to packaging boxes for accommodating an item or items in a secure manner.

Various packaging boxes are known, including boxes equipped for shipping items in a secure manner. For instance, sensitive items are often shipped in boxes with the items supported on blocks or on specially molded foamed polyurethane, or spaced from the side panels of the box by cardboard inserts, foamed polyurethane pellets or beads, or the so-called bubble-wrap sheets. These protective measures suppress the transmission to the items of impacts, shocks, vibrations and/or other forces to which the box itself may be subjected, but they sometimes are bulky, costly, difficult to handle, environmentally undesirable, and/or are non-compliant or do not conform to the items being shipped.

OBJECT AND SUMMARY OF THE INVENTION

An object of the invention is to provide alternative means for securing items being shipped in packaging boxes.

In accordance with an embodiment of the invention, a resilient element is provided within the box; the resilient element is capable of supporting, suspending and/or holding down an item or items being shipped. Because the resilient element is flexible, it acts as a shock absorber, such that forces on the box are absorbed in whole or in part to reduce or eliminate the transmission of such forces to the items being shipped.

The resilient element may be a part of an insert for placement within the box. The insert may comprise one or more panels to which the resilient element is attached. The resilient element may extend across the panel or panels for supporting, suspending and/or holding down the item or items to be shipped.

The resilient element may take many forms. For example, it may be in the form of a plastic film. Other suitable materials include fabrics, cellulose, rubbers, polymers, and any other material providing the desired pliability, elasticity, and/or flexibility. The shape of the resilient element may be in the form of a sheet, tube, pocket or any other suitable configuration. It may also have additional features, such as slits, holes, or punctures to allow the desired result with respect to the item or items to be secured. For example, a resilient element in the form of a mesh may be used to suspend an item, wherein slits or openings in the mesh permit the resilient element to support the item like a hammock.

As a specific example of an insert in accordance with an embodiment of the invention, an insert may comprise one or more plastic films glued to a rigid sheet of corrugated cardboard or other relatively rigid material for supporting, suspending and/or holding down the item or items to be shipped.

In accordance with certain embodiments of the invention, the box and the insert may both be constructed so that they may be shipped to the user in a substantially flat condition. For example, the insert may be made of a single flat sheet of corrugated cardboard, with one or more plastic films, each glued in at least two places to the flat sheet. For use, the ends of the sheet may be folded over to hold the item or items in place.

DETAILED DESCRIPTION OF THE ILLUSTRATED EMBODIMENTS

Figure 1:
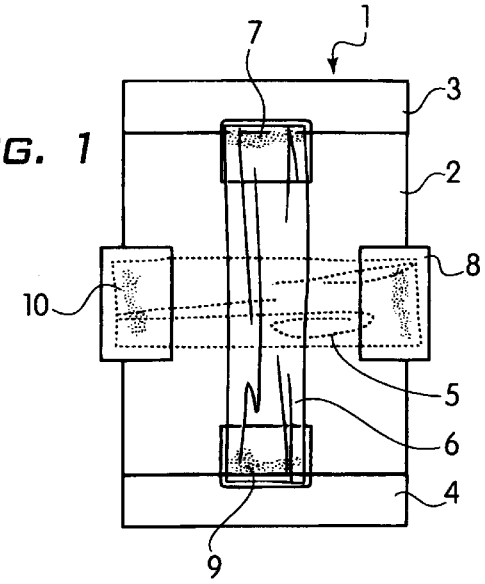
FIG. 1 shows an insert in accordance with a first embodiment of the invention.

FIG. 1 shows a sheet 1 for an insert in accordance with a first embodiment of the invention. The sheet 1 may be constructed, for example, of corrugated cardboard or any other suitable material. By suitably cutting and scoring the sheet 1, or through other means, the sheet 1 is provided with a main platform 2, end flaps 3 and 4 and strap flaps 7, 8, 9 and 10. In this illustrated embodiment, resilient elements 5 and 6 are attached by glue, represented by the spotted areas, to the strap flaps 7, 8, 9 and 10, although attachment may be accomplished in any other suitable manner. In this illustrated embodiment, the resilient elements 5 and 6 are plastic films, although any suitable material or configuration may be used. Strap flaps 7, 8, 9 and 10 extend beyond the boundary of platform 2.

Figure 2:
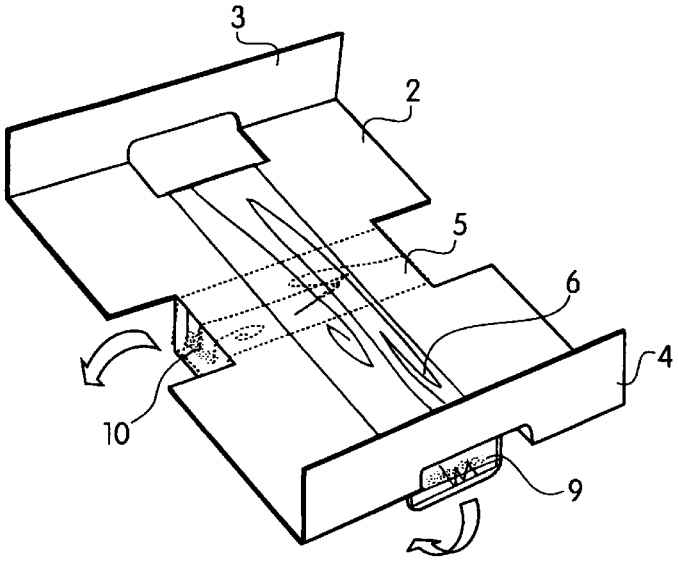
FIG. 2 shows a top perspective view of the insert of FIG. 1, with strap flaps and end flaps folded.
Figure 3:
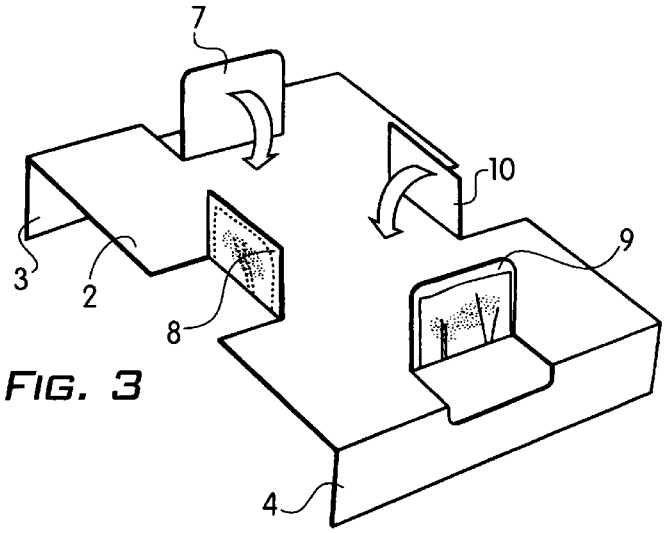
FIG. 3 shows a bottom perspective view of the insert as shown in FIG. 2.

For securing an item to be shipped, the item may be placed under the films 5 and 6, such that it lies between the platform 2, on the one side, and films 5 and 6 on the other side. The strap flaps 7, 8, 9 and 10 are then folded to tension the films 5 and 6 and secure the item. FIG. 2 shows sheet 1 of FIG. 1 in a folded configuration. Strap flaps 7, 8, 9 and 10 fold away from the top side of platform 2 to stretch the films 5 and 6 sufficiently to hold an item securely between platform 2 and films 5 and 6. End flaps 3 and 4 are folded towards the top side of platform 2. FIG. 3 shows sheet 1 of FIG. 2 from a bottom perspective, the end flaps 3 and 4 folded toward the top side of platform 2 and the strap flaps 7, 8, 9 and 10 folded toward the bottom side of platform 2. In this illustrated configuration, the end flaps 3 and 4 and the strap flaps 7, 8, 9 and 10 are folded to a 90 degree angle above and below the plane of platform 2, although many other angles are suitable. For example, the strap flaps 7, 8, 9 and 10 may be folded 180 degrees with respect to the platform 2, so that they rest against the bottom of the platform 2. In this manner, when the insert is placed in a box, it can lie substantially at the bottom of the box. Alternatively, the strap flaps 7, 8, 9 and 10 may be folded to a different angle, for example 45 degrees. In this manner, when the insert is placed in a box, the edges of the strap flaps can extend into and be secured by the corners between the sides and bottom of the box. With this arrangement, the platform 2 is lifted further off of the bottom of the box, and the strap flaps serve as further "shock absorbers" between the box and the platform.

As an alternative arrangement, strap flaps 7 and 9 can be folded slightly upward. Because of their length and because of the configuration of the corresponding cut out in end flaps 3 and 4, the strap flaps 7 and 8 will be held in place behind end flaps 3 and 4.

The insert may be suitably configured in accordance with the item or items to be shipped. For example, the platform 2 may be provided with one or more cutouts to allow a portion or portions of an object to extend below the surface of the platform 2.

Persons of ordinary skill in the art will appreciate that using an insert in accordance with the invention, in which a resilient element is used to support, suspend and/or hold down an item being shipped, is useful in securing the item during shipping. The insert secures the item in place, and the resiliency of the resilient element helps absorb shock. The resilient element also distances the item away from sides of the box, which may be subject to puncture or other damage. In addition, because of the flexibility of the resilient element, it is able to conform substantially to the item or items being shipped, which is especially useful for items having odd-shaped configurations. Also, certain configurations of resilient elements in accordance with the invention, for example those with slits or holes or those in the form of a pocket, allow protrusions from the item to project and to be suspended, thereby protecting such protrusions, which may be fragile.

It will be appreciated that the insert may be suitably modified to form a complete shipping container by itself. For example, sheet 1 could be provided with further panels that would fold to form sides and tops of a box. In this manner, the construction forms a folder to be shipped alone, rather than an insert to be placed inside a shipping container. The folder, of course, could also be placed inside another shipping container.

Whether the packaging item is an insert, a folder or other suitable configuration, various modifications may be made. For example, the rigid sheet may take any shape or size, and various configurations of strap flaps and/or end flaps may be used. As just one example, with a rectangular rigid sheet as shown in FIGS. 1 to 3, four end flaps may be provided, one on each edge of the sheet. Thus, the end flaps may be folded upward to form a tray or downward to provide support against the bottom of a container.

Figure 4:
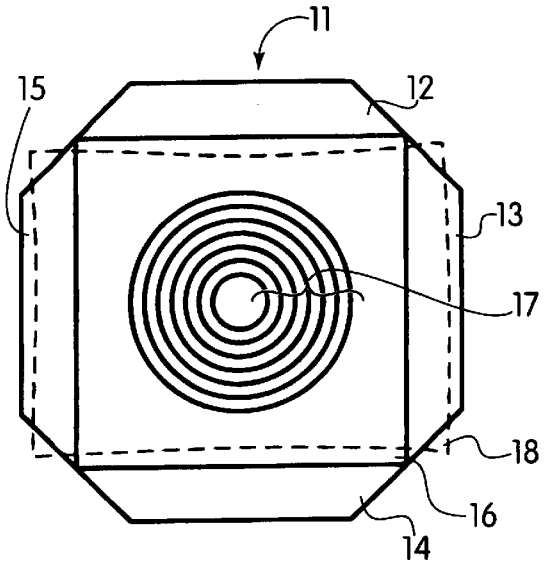
FIG. 4 shows an insert in accordance with another embodiment of the invention.

FIG. 4 shows a sheet 11 for an insert in accordance with another embodiment of the invention. In this illustrated embodiment, the center of platform 16 is cut into securement elements or rings 17 of varying sizes, although other shapes may be suitable as well. In this illustrated embodiment, resilient element 18 is attached specifically to strap flaps 13 and 15 across the top side of platform 16; however, the film 18 alternatively may be attached directly to platform 16. Another film 19 (shown in FIGS. 6 and 7) is attached to the other side of the sheet 11.

Figure 5:
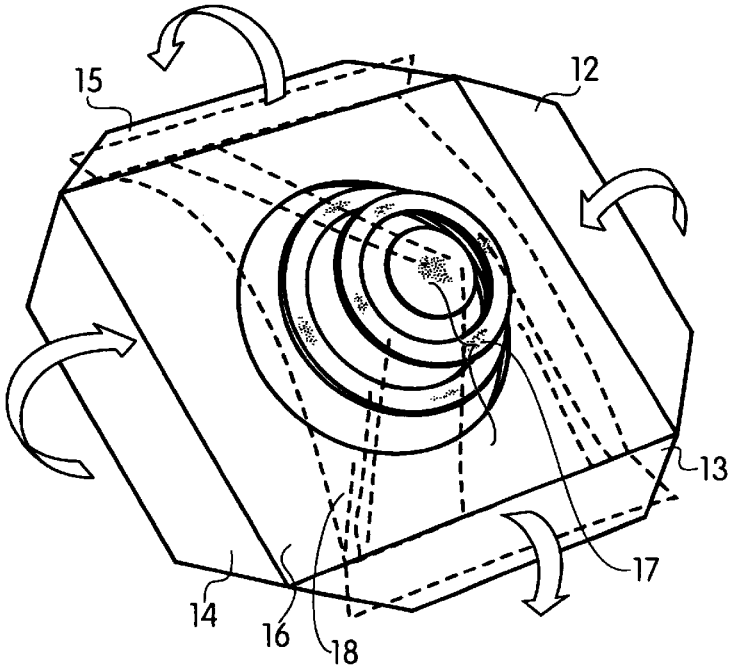
FIG. 5 shows a top perspective view of the insert of FIG. 4, with the films and multiple rings extended and strap flaps folded.

FIG. 5 shows the insert of FIG. 4 in its extended configuration. The rings 17 are attached to the film 18 and extends away from the plane of platform 16. This assists in securing the item by supporting and suspending the item away from the sides of the box which may be subject to physical damage. The rings 17 also help accommodate objects of different sizes. Strap flaps 13 and 15 fold downward, sufficiently pulling film 18 to hold an item securely against the rings 17.

Figure 6:
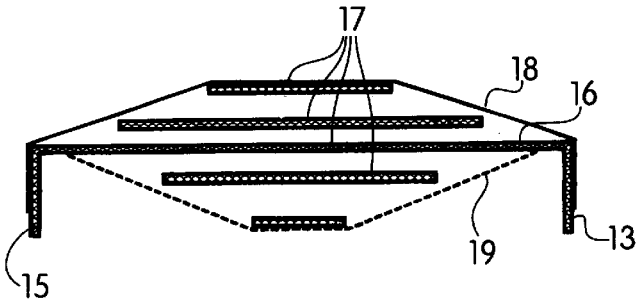
FIG. 6 shows a side view of the insert as shown in FIG. 5 oriented horizontally.

FIG. 6 shows resilient element 18 attached to the top side of sheet 11 (to straps flaps 13 and 15) while another resilient element 19 is attached to the bottom side of sheet 11 (to strap flaps 12 and 14). Strap flaps 13 and 15 are folded downward to stretch resilient element 18, and strap flaps 12 and 14 are folded upward to stretch resilient element 19, although other orientations of the strap flaps are possible. The rings 17 may be selectively attached either to resilient element 18 to extend above the plane of platform 16 or to resilient element 19 to extend below the plane of platform 16, or, alternatively, one or more of the rings 17 may be completely detached from films 18 and 19 but still be used to secure an item to be shipped and provide additional protection from physical shocks.

Figure 7:
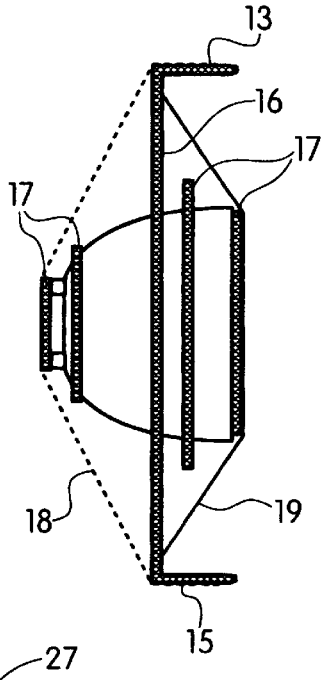
FIG. 7 shows a side view of the insert as shown in FIG. 5 oriented vertically, with the multiple rings holding an item in place.

As with other inserts shown or described herein, the insert may be oriented in a horizontal direction or in other directions, including vertical. FIG. 7 shows sheet 11 securing an item while oriented in the vertical position, with rings 17 extending to the right and left of platform 16. Strap flaps 13 and 15 are folded away from the side to which film 18 is attached to stretch resilient element 18. Flaps 12 and 14 are not shown in FIG. 7, but flaps 12 and 14 (visible in FIG. 15) fold such that tension is created across film 19 (visible in FIG. 7).

Figure 8:
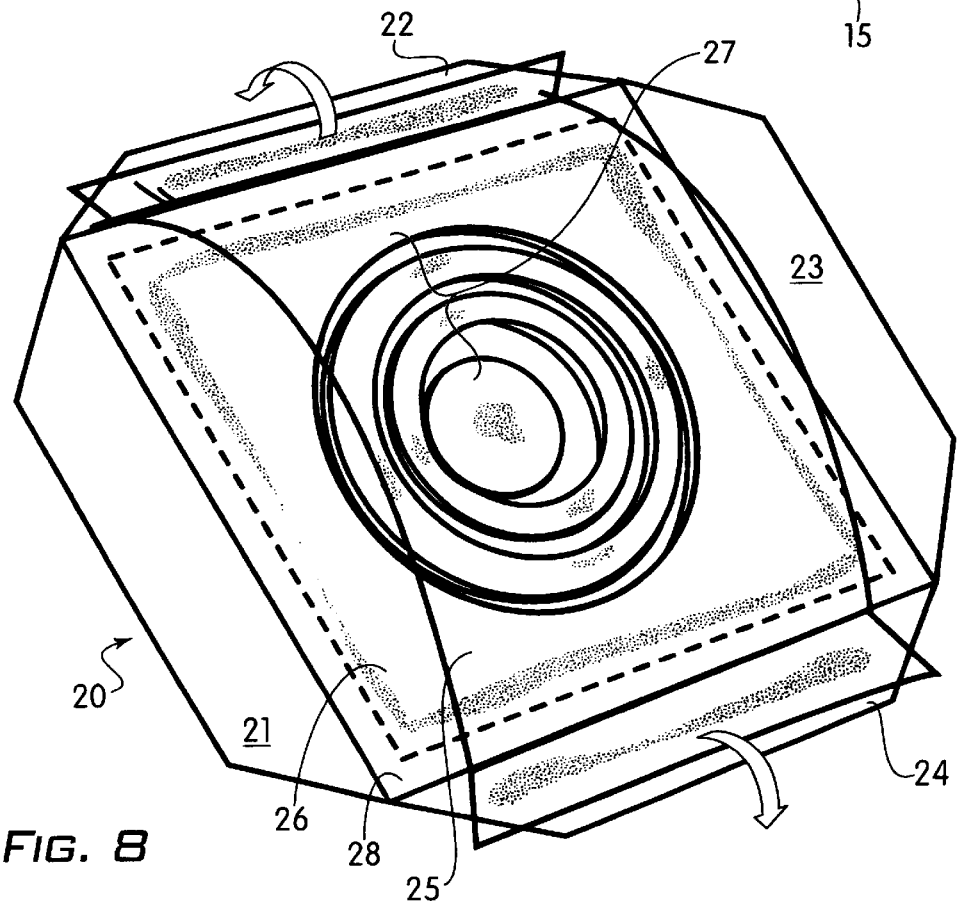
FIG. 8 shows a top perspective view of a variation of the insert of FIG. 4 with the films glued to the same side of the insert.

FIG. 8 shows an embodiment of the invention similar to FIG. 4, the main difference being that the films 25 and 26 are both attached to the same side of sheet 20. Since the rings 27 are cut out of the platform 28, in this embodiment, the rings 27 are attached directly to film 26. Other arrangements are of course possible. Film 25 is attached to strap flaps 22 and 24 which can be folded away from the side to which film 25 is attached to stretch resilient element 25. Film 26 is attached directly to the platform 28, leaving flaps 21 and 23 to serve as end flaps. An item is placed between films 25 and 26 and is secured by the resilient elements supporting, suspending, and/or holding down the item.

Figure 9:
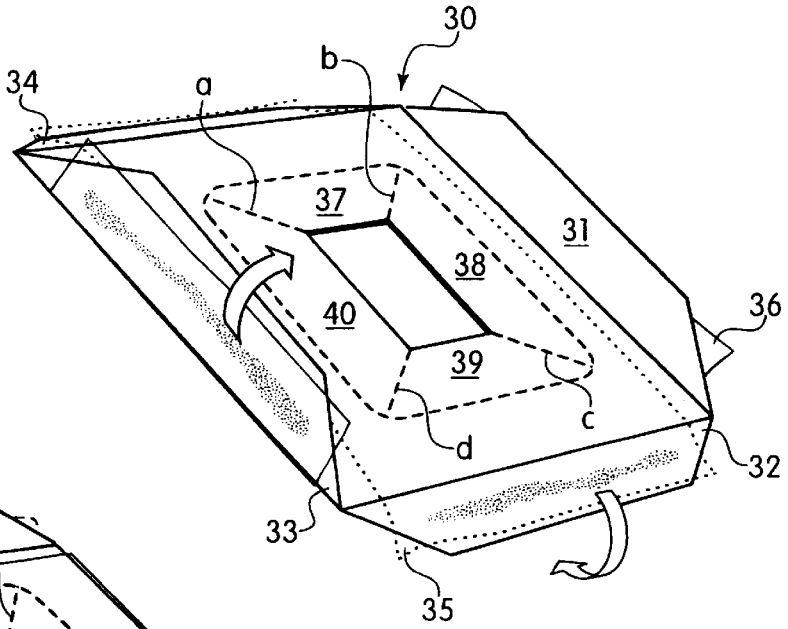
FIG. 9 shows a top perspective view of an insert in accordance with another embodiment of the invention with the flaps folded.
Figure 10:
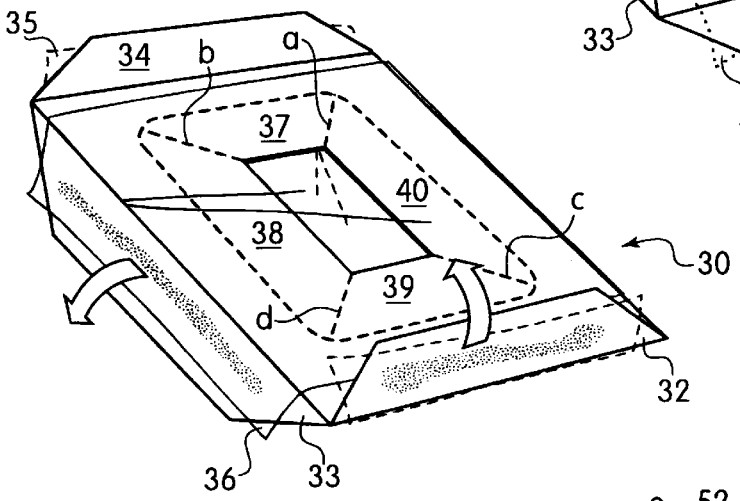
FIG. 10 shows a bottom perspective view of the insert of FIG. 9 with the flaps folded.

FIGS. 9 and 10 show top and bottom views of another embodiment of the invention. Two films 35 and 36 are attached to opposite sides of sheet 30. Film 35 is attached to the top side of strap flaps 32 and 34; film 36 is attached to the bottom side of strap flaps 31 and 33. The strap flaps and plastic films operate similarly to the strap flaps and plastic films in the other embodiments. Inner flaps 37, 38, 39 and 40 provide additional support for an item. Flaps 37, 38, 39 and 40 may be either connected to each other at joints a, b, c and d or may be separated at a, b, c and d. Perforations allow the joints to yield, permitting the flaps to bend according to the shape of an item to be shipped. The flaps help hold the item more securely in place. These flaps may fold upward or downward to contain an item or items and/or to locate and/or position an item or items.

Figure 11:
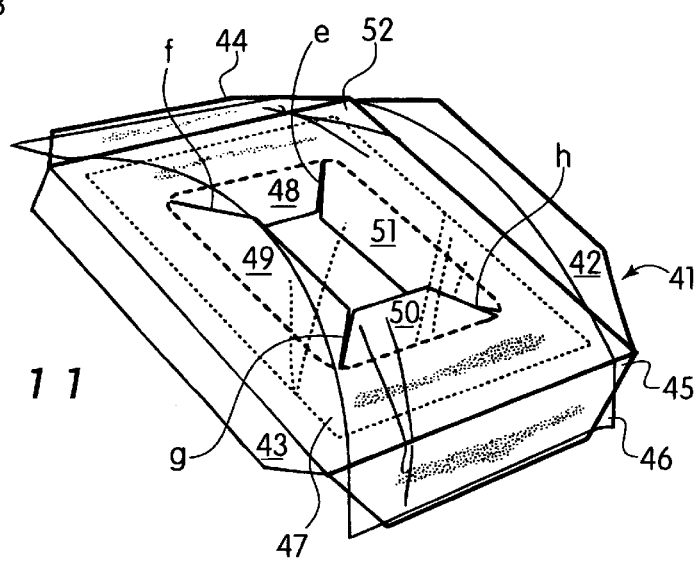
FIG. 11 shows a variation of the insert of FIG. 9 with both films attached on the same side of the insert.

FIG. 11 shows an embodiment similar to that shown in FIGS. 9 and 10; however, the plastic films 46 and 47 are both attached to the same side of sheet 41. Film 46 is attached to strap flaps 44 and 45; film 47 is attached directly to platform 52, not to flaps 42 and 43. Inner flaps 48, 49, 50 and 51 may be either connected to each other or may be separated at joints e, f, g, and h. The inner flaps 48, 49, 50 and 51 function similarly to inner flaps 37, 38, 39 and 40 in the embodiment shown in FIGS. 9 and 10.

Figure 12:
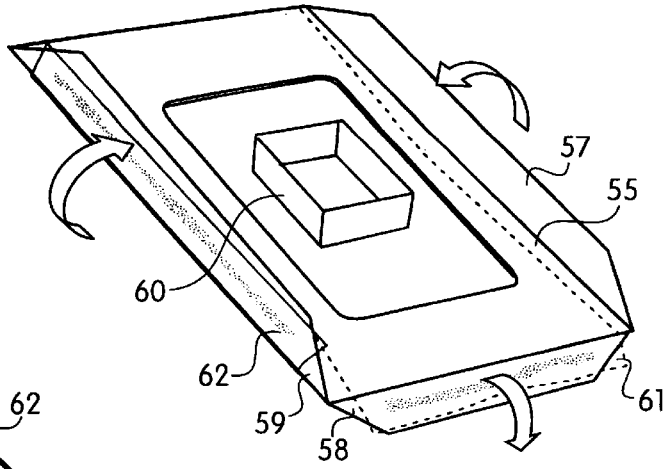
FIG. 12 shows a top perspective view of an insert in accordance with another embodiment of the invention, with the flaps folded.
Figure 13:
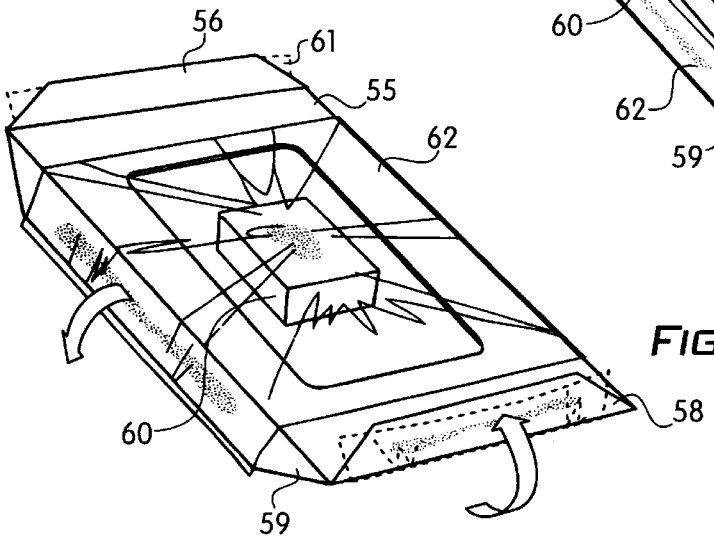
FIG. 13 shows a bottom perspective view of the insert of FIG. 12.
Figure 14:
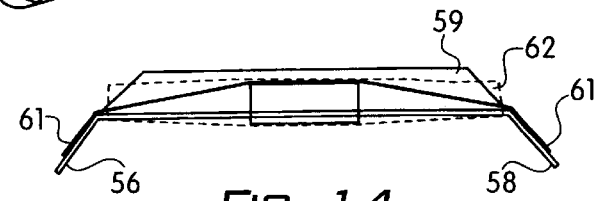
FIG. 14 shows a side view of the insert of FIG. 12.

FIGS. 12, 13, and 14 respectively show top, bottom and side views of an embodiment wherein plastic films 61 and 62 are attached to opposite sides of the insert. The films 61 and 62 are attached respectively to strap flaps 56, 58 and 57, 59 which function in substantially the same way as described previously.

Platform 55 has an aperture where a container 60 may be glued and suspended between the two plastic films 61 and 62. In the illustrations, the container 60 is in the shape of a box, however, the container may vary in shape and size. This container 60 may function to hold delicate objects securely without the pressure from the plastic films pressing down. Container 60 may also function to hold an end of an item securely in place. Different structures, such as partitions, pads, scored sheets, etc., may additionally or alternatively be placed in the aperture of the platform 55, and attached to or detached from the adjacent film.

Figure 15:
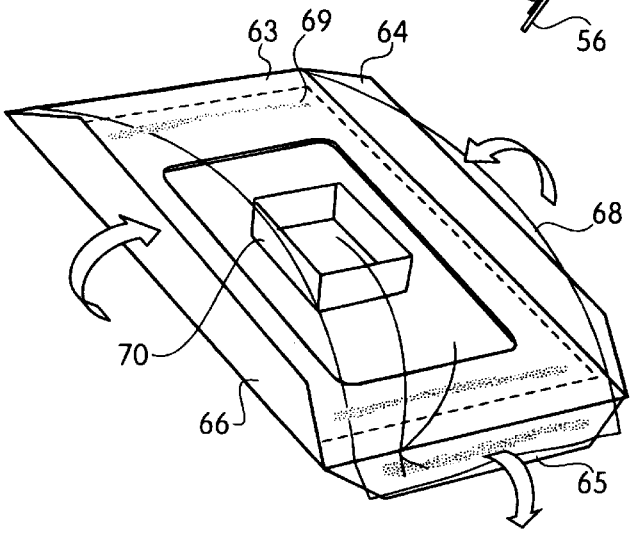
FIG. 15 shows a top perspective view of a variation of the insert of FIG. 12, with the films glued to the same side of the insert.

FIG. 15 shows a top view of an embodiment similar to that shown in FIGS. 12, 13, and 14, the main difference being that the two films 68 and 69 are attached to the same side of the insert. Film 68 is attached to strap flaps 65 and 67 (not shown in FIG. 15); film 69 is attached directly to platform 63, not to flaps 64 and 66. The container 70 is shown as glued in place between films 68 and 69. This embodiment functions substantially similarly as described previously.

Figure 16:
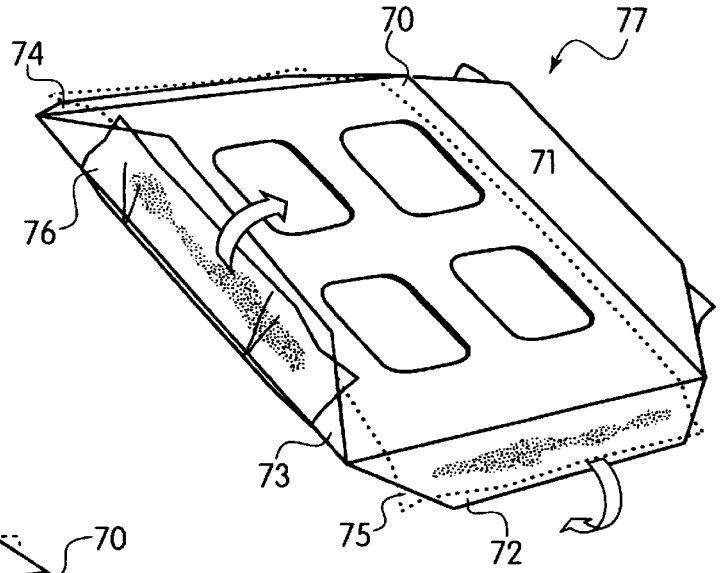
FIG. 16 shows a top perspective view of an insert in accordance with another embodiment of the invention, with the flaps folded.
Figure 17:
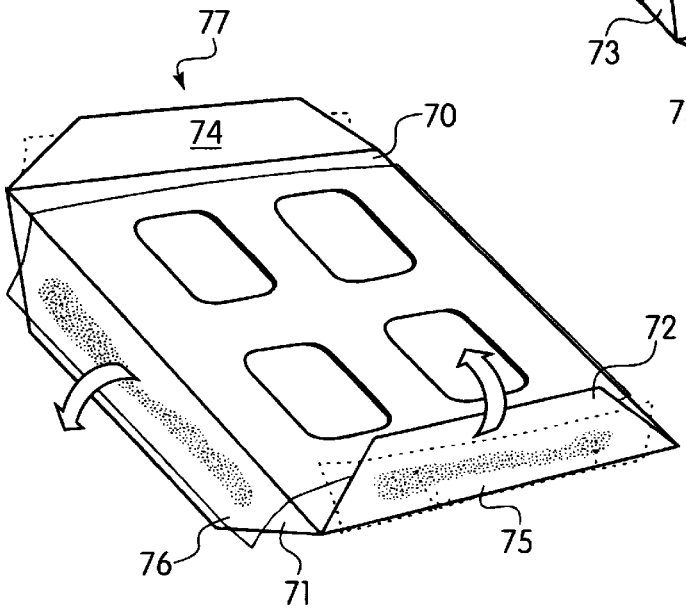
FIG. 17 shows a bottom perspective view of the insert of FIG. 16.

FIGS. 16 and 17 respectively show top and bottom views of another embodiment. The plastic films 75 and 76 are respectively attached to strap flaps 72, 74 and 71, 73 on the opposite sides of the sheet 77. The films and strap flaps function in a similar manner as described previously. Platform 70 has four apertures (or cut outs) so that more than one item can be packed in the same insert and each item can be securely separated from the others. The number and shapes of the cutouts may vary to suit the needs of the shipper and the shape of the items to be shipped.

Figure 18:
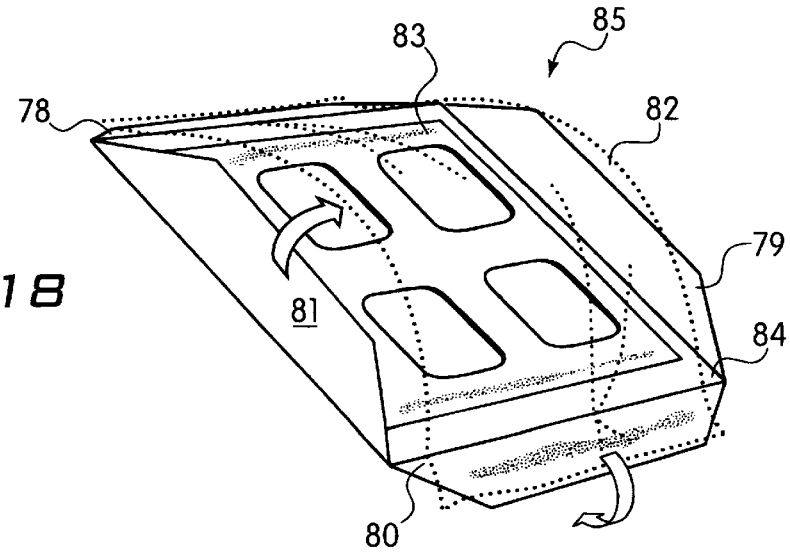
FIG. 18 shows a top perspective view of a variation of the insert of FIG. 16, with the films glued to the same side of the insert.

FIG. 18 shows an alternative embodiment similar to the embodiment shown in FIGS. 16 and 17. In this embodiment, the plastic films are both attached to the same side of the sheet 85. Film 82 is attached to strap flaps 78 and 80 while film 83 is attached directly to platform 84, not to flaps 79 and 81. The operation of the insert is similar to that described above. Similar to the embodiment in FIGS. 16 and 17, the shape and number of cutouts may vary to suit the needs of the shipper and the items to be shipped.

Figure 19:
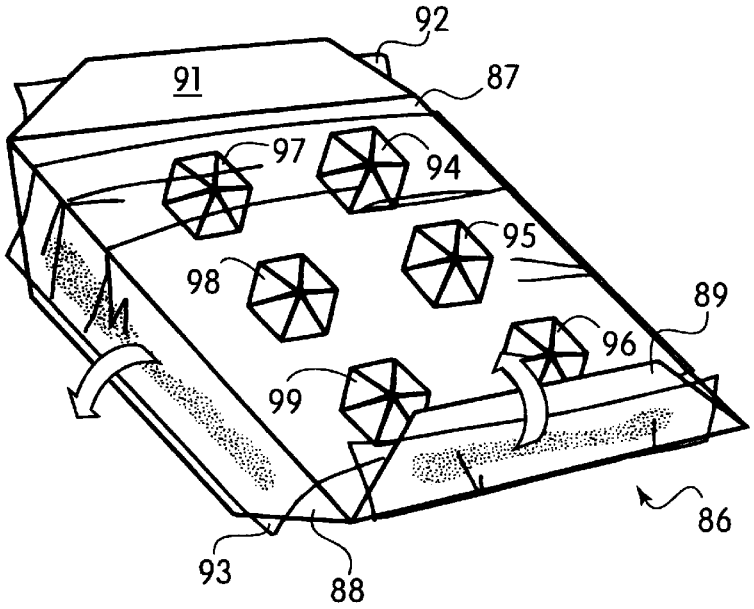
FIG. 19 shows a top perspective view of an insert in accordance with another embodiment of the invention, with the flaps folded.
Figure 20:
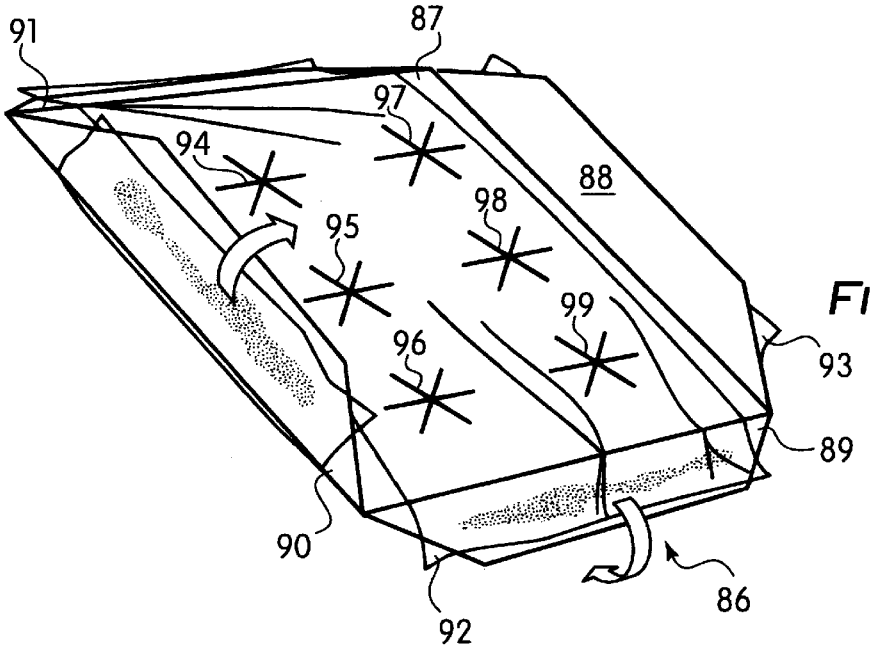
FIG. 20 shows a bottom perspective view of the insert of FIG. 19.
Figure 21:
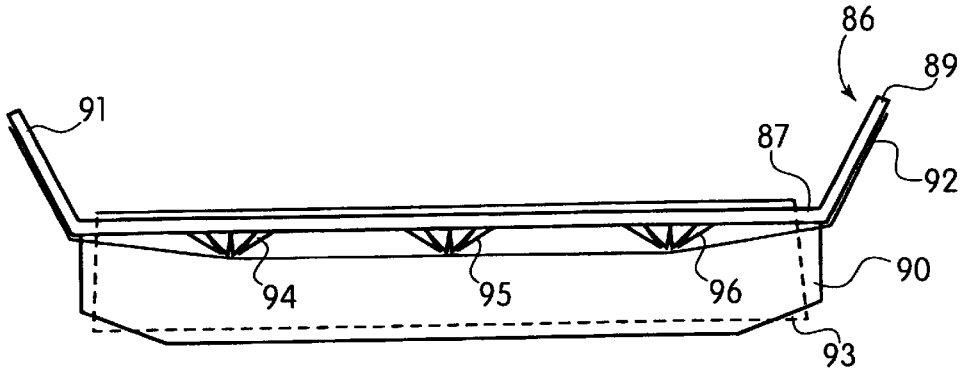
FIG. 21 shows a side view of the insert of FIG. 19.

FIGS. 19, 20 and 21 respectively show top, bottom and side cross-sectional views of another embodiment of the invention. In this embodiment, platform 87 has six item securing sites 94, 95, 96, 97, 98 and 99 for items to be loaded. Each site is formed by three slits crossing each other at the midpoint. The number of sites, number of slits per site and the orientation of the slits may vary to suit the shape, size, and design of the items to be shipped. The slits form flaps that can be bent upward or downward when loading an item to provide support in addition to that which plastic films 92 and 93 provide. Films 92 and 93 are respectively attached to strap flaps 89, 91 and 88, 90. The sites 94, 95, 96, 97, 98 and 99 allow more than one item to be packed per insert and keep each loaded item securely separated away from the others. As with other embodiments, the item for shipping may extend above and/or below the surface of platform 87.

Figure 22:
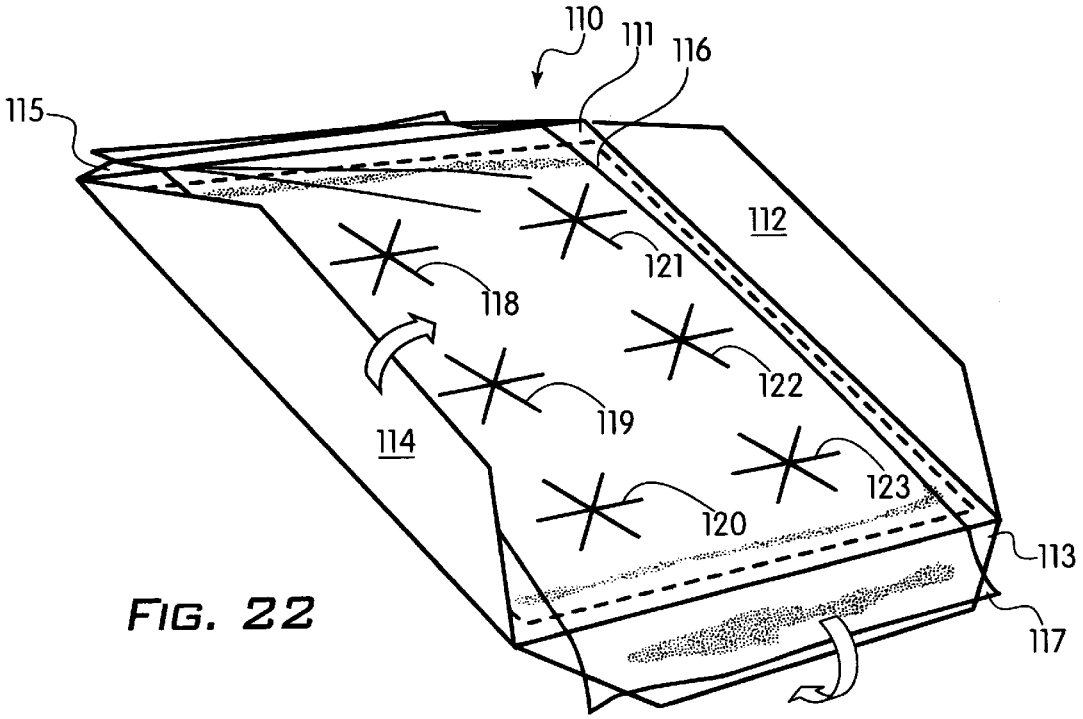
FIG. 22 shows a top perspective view of another variation of the insert of FIG. 19, with both films glued to the same side of the insert.

FIG. 22 shows an alternative embodiment similar to the embodiment shown in FIGS. 19–21. In FIG. 22, however, the two films 116 and 117 are attached to the same side of sheet 110. Film 117 is attached to strap flaps 113 and 115; therefore, the tension across the film can be adjusted by folding the strap flaps downward. Film 116 is attached directly to platform 111, not to flaps 112 and 114. The item securing sites 118, 119, 120, 121, 122 and 123 are similar to the item securing sites of FIGS. 19–21.

Figure 23:
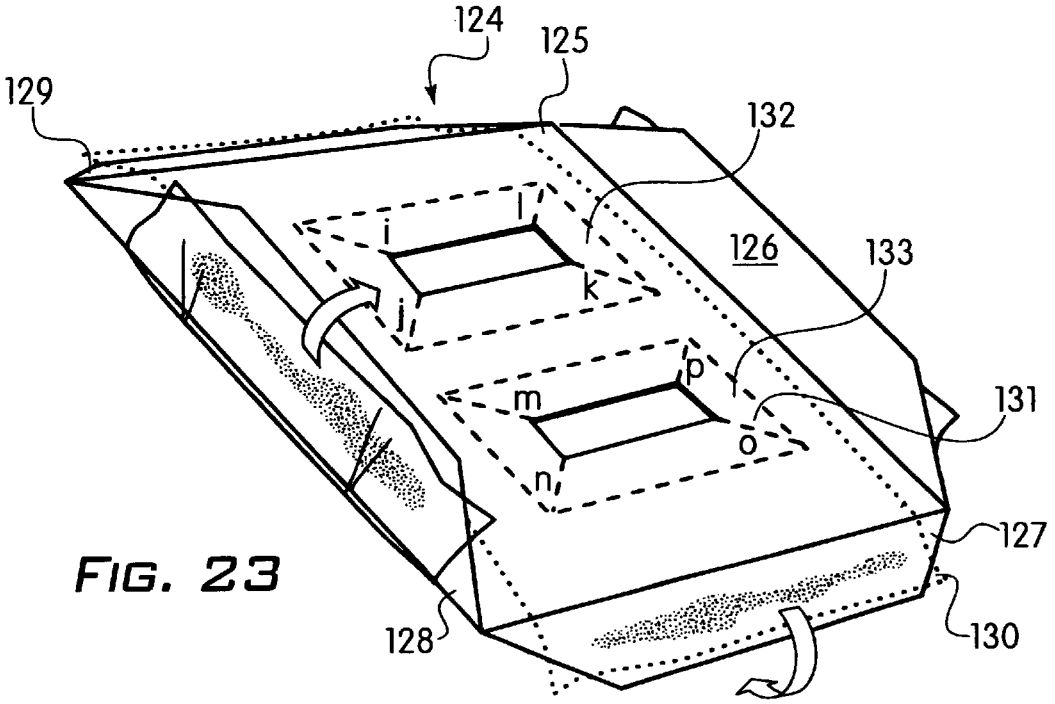
FIG. 23 shows a top perspective view of an insert in accordance with another embodiment of the invention, with the flaps folded.
Figure 24:
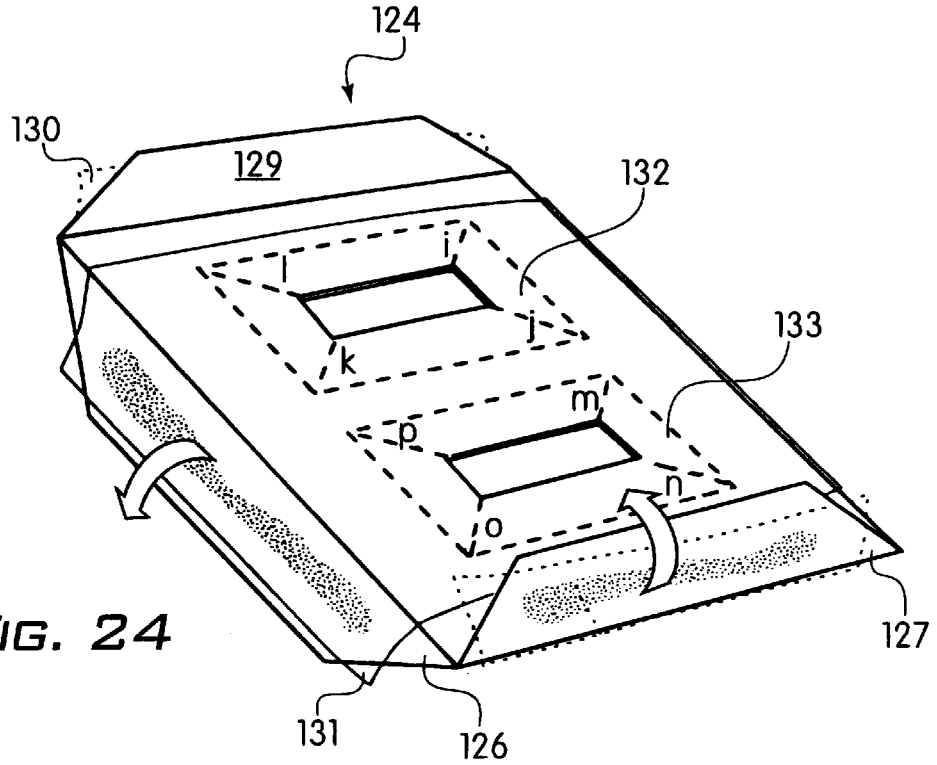
FIG. 24 shows a bottom perspective view of the insert of FIG. 23.

FIGS. 23 and 24 respectively show top and bottom views of another embodiment. Similar to the previous embodiments, there are two plastic films 130 and 131 which are respectively attached to strap flaps 127, 129 and 126, 128 on the opposite sides of sheet 124. In this illustrated embodiment, there are two item securing sites 132 and 133 on platform 125 which are perforated at joints i, j, k, l, m, n, o and p to yield to the shape of an item. The inner flaps function similarly as discussed previously, to allow for more than one item to be packed into one insert and to keep items securely separated from each other. In addition, the size, shape and number of item securing sites may vary according to the needs of the customer. The inner flaps can fold to different positions to perform different and independent functions.

Figure 25:
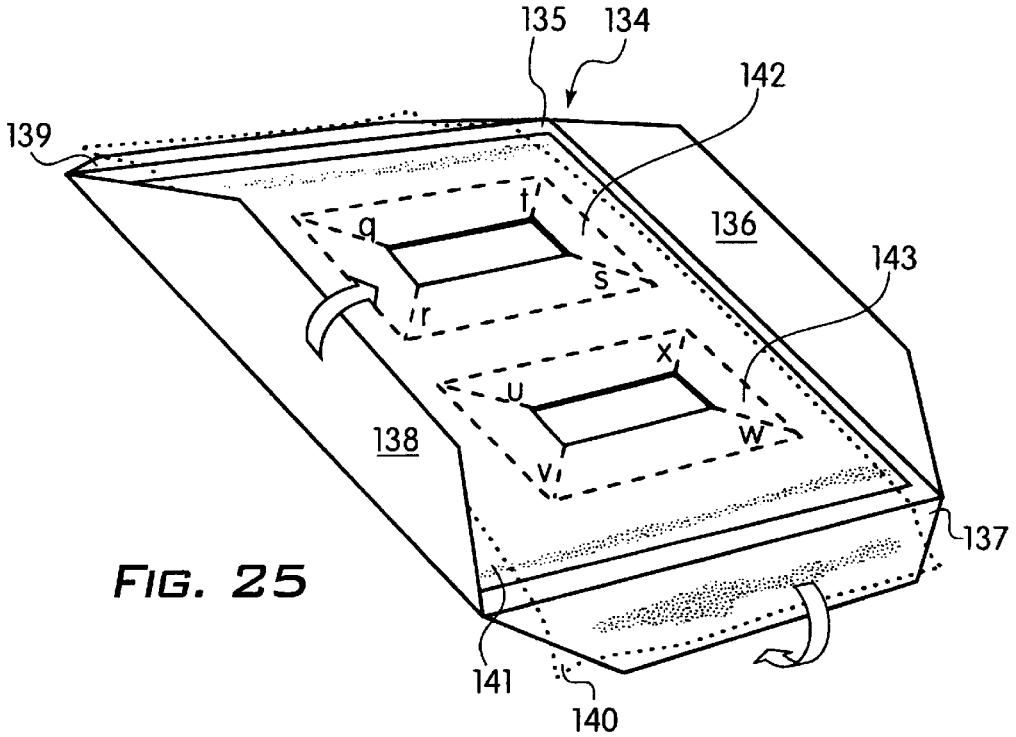
FIG. 25 shows a variation of the embodiment of FIG. 23, with the films glued to the same side of the insert.

FIG. 25 shows an alternative embodiment of insert 124 where the plastic films 140 and 141 are attached to the same side of sheet 134. Film 140 is attached to strap flaps 137 and 139 and functions similarly as described previously; film 141 is attached directly to platform 135, not to flaps 136 and 138. Insert 134 has two item securing sites 142 and 143, perforated at joints q, r, s, t, u, v, w and x to yield to the shape of an item. Similar to the embodiment of FIGS. 23 and 24, the number, shape and size of the sites may vary. The items are placed between the plastic films 140 and 141 and are held in place by the item securing sites and the tension from plastic films 140 and 141.

Figure 26:
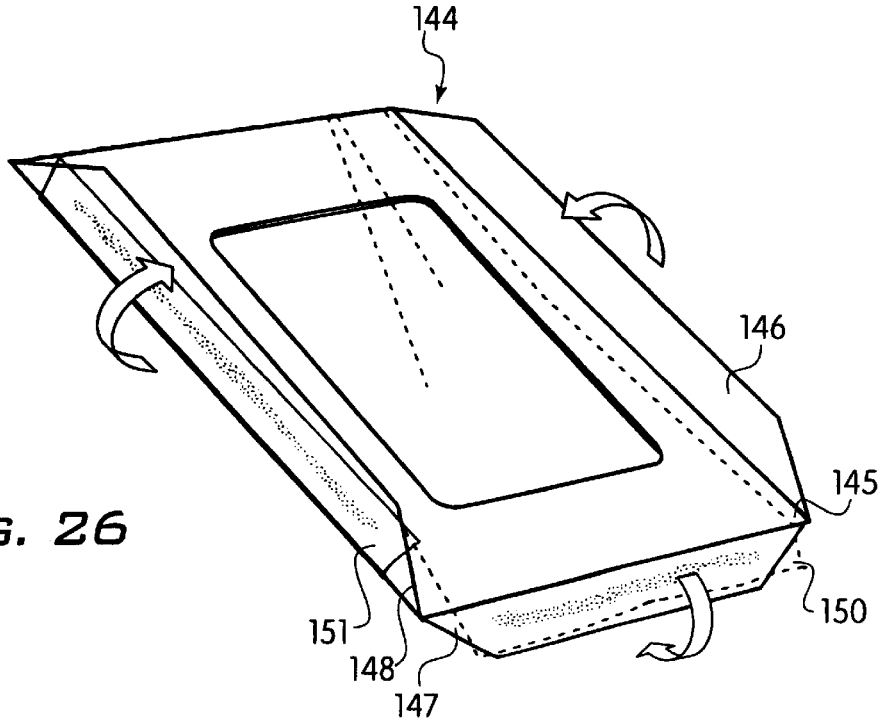
FIG. 26 shows a top perspective view of an insert in accordance with another embodiment of the invention, with the flaps folded.
Figure 27:
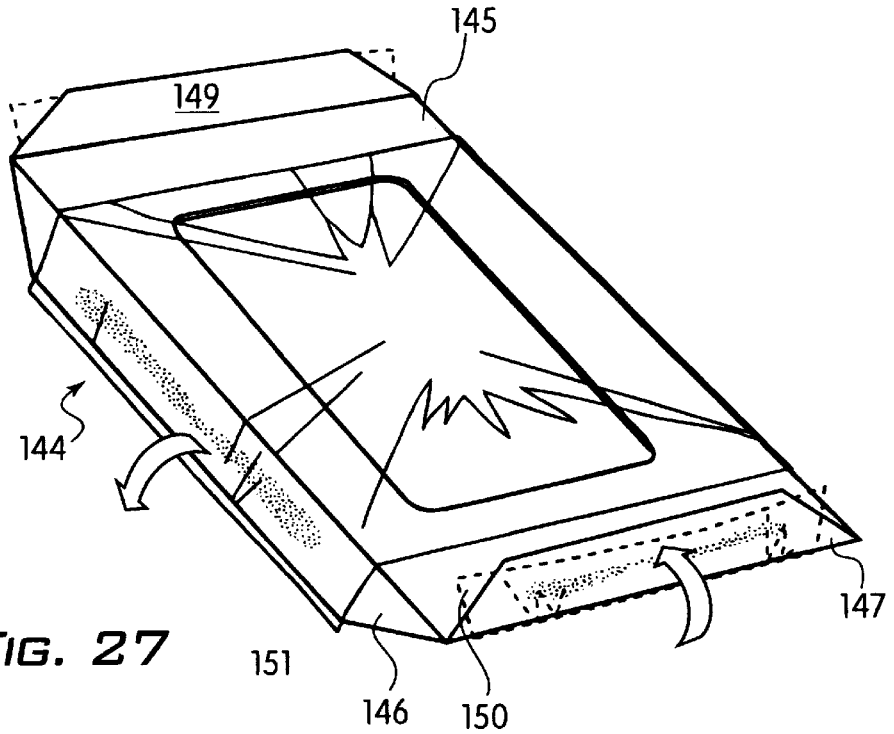
FIG. 27 shows a bottom perspective view of the insert of FIG. 26.

FIGS. 26 and 27 respectively show the top and bottom views of another embodiment. This embodiment shows a large aperture in platform 145 to hold, secure and/or suspend an item between plastic films 150 and 151. Films 150 and 151 are respectively attached to strap flaps 147, 149 and 146, 148. The strap flaps function in the same fashion as described previously. As a modification of this embodiment, the platform 145 may be continuous with no aperture, such that the films 150 and 151 can be used to secure items on opposite sides of the platform 145. Using a continuous platform and/or modifying the aperture can also be applied to prior embodiments. For example, the platform 55 in the embodiment of FIGS. 12 through 14 may be continuous, with no aperture, such that the container 60 rests between the platform and one of the films.

Figure 28:
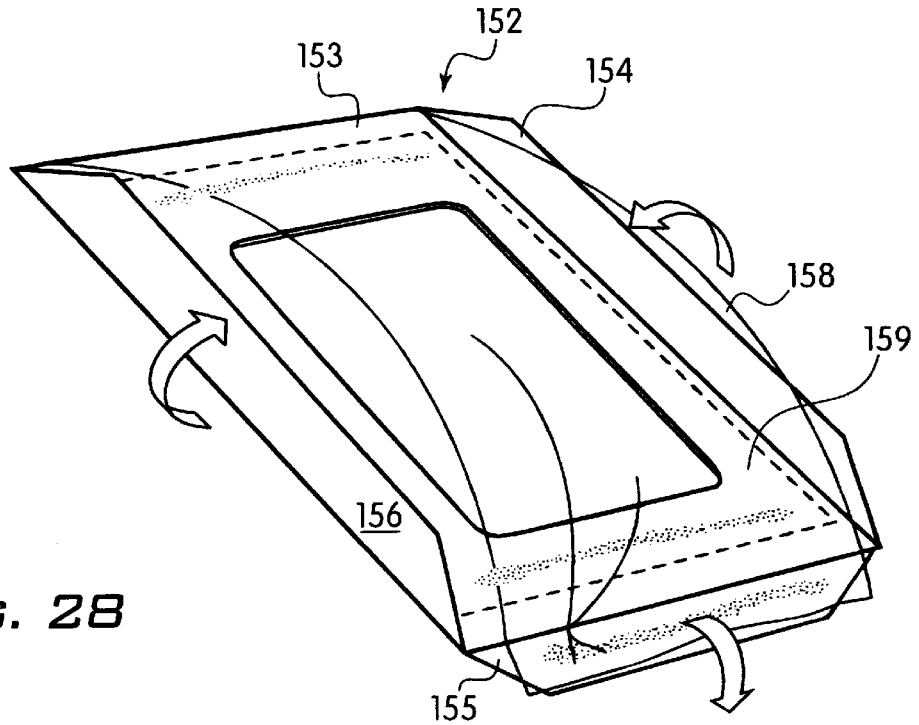
FIG. 28 shows a variation of the insert of FIG. 26, with the films glued to the same side of the insert.

FIG. 28 shows an alternative embodiment where the two films are attached to the same side of sheet 152. Film 158 is attached to strap flaps 155 and 157 (strap flap 157 is not shown in this drawing); film 159 is attached directly to platform 153, not to flaps 154 and 156. This insert functions substantially in the same way as the insert of FIGS. 26 and 27.

It will be appreciated that various modifications can be made to the above embodiments without departing from the scope of the invention. For example, the strap flaps and end flaps may be modified in shape and/or size and may be bent to various angles, as described above. The inserts can be modified into self-contained folders. The films may be placed on opposite sides of the insert or on the same side. Various cut outs may be used in the platform, with or without bendable flaps, movable rings or attached containers of various shapes and/or sizes, which may or may not be adhered to the plastic film. The films may be heat-shrinkable for purposes of increased or decreased elasticity. The position and/or shape of the adhesive may be varied to create pockets and/or variable tension to elastic film. The films may be pressed on or around an item for self-adherence to reduce slippage of an item.

While the above description provides various alternative constructions, the scope of the invention is defined by the appended claims.

What is claimed is:

1. A packaging item comprising:

(a) a relatively rigid sheet comprising a platform, a first strap flap foldable with respect to the platform about a first fold line and a second strap flap foldable with respect to the platform about a second fold line, wherein the second fold line extends in a direction substantially perpendicular to a direction in which the first fold line extends;

(b) a first resilient element attached to the relatively rigid sheet, wherein the first resilient element extends substantially across the platform of the relatively rigid sheet and wherein the first resilient element is attached to the first strap flap; and (c) a second resilient element attached to the relatively rigid sheet, wherein the second resilient element extends substantially across the platform of the relatively rigid sheet and wherein the second resilient element is attached to the second strap flap.

2. A packaging item as recited in claim 1, wherein the relatively rigid sheet further comprises at least one end flap.

3. A packaging item as recited in claim 2, further comprising at least one cut out in the at least one end flap, wherein, when one of said strap flaps is folded, it extends through said cut out and behind the at least one end flap so that the at least one end flap holds the strap flap to maintain the position of the strap flap.

4. A packaging item as recited in claim 1, wherein the packaging item may be positioned within a container, and at least one of said strap flaps is held in position by the container.

5. A packaging item comprising:

(a) a relatively rigid sheet comprising a platform and a first strap flap foldable with respect to the platform, wherein said platform has at least one aperture in it for accommodating at least one item;

(b) a first resilient element attached to the relatively rigid sheet, wherein the first resilient element extends substantially across the platform of the relatively rigid sheet and substantially over said at least one aperture and wherein the first resilient element is attached to the first strap flap; and (c) a second resilient element attached to the relatively rigid sheet, wherein the second resilient element extends substantially across the platform of the relatively rigid sheet and substantially over said at least one aperture.

6. A packaging item as recited in claim 5, wherein the relatively rigid sheet further comprises a second strap flap and wherein the first resilient element is also attached to the second strap flap.

7. A packaging item as recited in claim 5, wherein the platform of the relatively rigid sheet is cut to form at least one securement element which provides additional support for objects of various shapes to be shipped.

8. A packaging container as recited in claim 7, wherein said at least one securement element is attached to one of the resilient elements.

9. A packaging container as recited in claim 7, wherein said at least one securement element is not attached to either of the resilient elements.

10. A packaging item as recited in claim 5, wherein the relatively rigid sheet further comprises a second strap flap and wherein the second resilient element is attached to the second strap flap.

11. A packaging item as recited in claim 5, wherein the first resilient element is positioned on a first side of the platform and the second resilient element is positioned on a second side of the platform such that the aperture is between the first resilient element and the second resilient element.

12. A packaging item as recited in claim 11, wherein a container is placed in the aperture between the first and second resilient elements to securely suspend an item.

13. A packaging item as recited in claim 11, wherein a partitioning element is placed in the aperture between the first and second resilient elements to separate items.

14. A packaging item as recited in claim 11, wherein a pad is placed in the aperture between the first and second resilient elements to cushion an item.

15. A packaging item as recited in claim 5, wherein the platform of the relatively rigid sheet has one or more flaps bordering the aperture.

16. A packaging item as recited in claim 15, wherein the flaps bordering the aperture are foldable to secure an item to be shipped.

17. A packaging item as recited in claim 5, wherein a plurality of apertures are located in the platform of the relatively rigid sheet.

18. A packaging item as recited in claim 5, wherein the first and second resilient elements are attached to the same side of the relatively rigid sheet.

19. A packaging item as recited in claim 5, wherein the first and second resilient elements are attached to opposite sides of the relatively rigid sheet.

* * * * *